US011825961B2

(12) United States Patent
Rocha

(10) Patent No.: US 11,825,961 B2
(45) Date of Patent: Nov. 28, 2023

(54) NEWBORN SLEEP INSERT FOR BASSINETTE AND CRIB

(71) Applicant: BABYMAZING SOLUTIONS, LLC, Reston, VA (US)

(72) Inventor: Daniel Quintino Rocha, Brambleton, VA (US)

(73) Assignee: BABYMAZING SOLUTIONS, LLC, Reston, VA (US)

( * ) Notice: Subject to any disclaimer, the term of this patent is extended or adjusted under 35 U.S.C. 154(b) by 0 days.

(21) Appl. No.: 17/826,133

(22) Filed: May 26, 2022

(65) Prior Publication Data

US 2022/0279936 A1 Sep. 8, 2022

Related U.S. Application Data

(63) Continuation of application No. 16/575,026, filed on Sep. 18, 2019, now Pat. No. 11,357,336.

(60) Provisional application No. 62/733,031, filed on Sep. 18, 2018.

(51) Int. Cl.
*A47D 9/00* (2006.01)

(52) U.S. Cl.
CPC ..... *A47D 9/016* (2022.08)

(58) Field of Classification Search
None
See application file for complete search history.

(56) References Cited

U.S. PATENT DOCUMENTS

| | | | | |
|---|---|---|---|---|
| 5,778,465 | A | 7/1998 | Myers | |
| 6,170,101 | B1 | 1/2001 | McCloud | |
| 7,404,219 | B2 | 7/2008 | Berkey | |
| 9,943,175 | B1 | 4/2018 | Spencer | |
| 2005/0210580 | A1 * | 9/2005 | Clapper | A47D 9/00 5/655 |

FOREIGN PATENT DOCUMENTS

| | | | |
|---|---|---|---|
| GB | 2501526 | A | 10/2013 |
| WO | 2018/087798 | A1 | 5/2018 |

OTHER PUBLICATIONS

Non-Final Office Action, U.S. Appl. No. 16/575,026 (dated Feb. 19, 2021).
Final Office Action, U.S. Appl. No. 16/575,026 (dated Sep. 22, 2021).
Notice of Allowance, U.S. Appl. No. 16/575,026 (dated Feb. 9, 2022).

* cited by examiner

*Primary Examiner* — Justin C Mikowski
*Assistant Examiner* — Adam C Ortiz
(74) *Attorney, Agent, or Firm* — Jayne Saydah, Esq., LLC

(57) ABSTRACT

A bassinette or crib sleep insert has converging sidewalls that are suspended around a top end of the bassinette or crib and terminate at a sleep surface at the bottom of the insert. Breathable cuddling bumpers are placed in the right location and with the right space to cuddle the baby. A wide lateral mesh window allows parents to see the baby through the mesh while lying in bed. Preferably, all material are soft and breathable, providing a safe environment for the baby.

8 Claims, 3 Drawing Sheets

NEWBORN SLEEP INSERT FOR BASSINETTE AND CRIB

CROSS-REFERENCE TO RELATED APPLICATIONS

This application is a continuation of U.S. patent application Ser. No. 16/575,026, filed Sep. 18, 2019, which claims the benefit of and priority to U.S. Provisional Patent Application No. 62/733,031, filed Sep. 18, 2018, the entire contents of both of which are incorporated herein by reference.

BACKGROUND OF THE INVENTION

Field of Invention

The present invention relates to bassinettes or cribs, and more particularly for bedding.

Description of the Related Art

Newborn babies have trouble adapting to this new world and regularly have trouble sleeping in wide areas such as cribs and bassinettes. Current solutions are not always safe for keeping an infant in a desired sleeping position.

Parents of a newborn, on the other hand, suffer from sleep deprivation during the first months with a baby, which may result in other health problems.

Conventional bassinette and crib bedding that are available do not provide the cuddling feeling to soothe the baby because they are too wide in the sleeping area. In other products, parents will normally need to get up from their bed in order to check to see if their baby is sleeping safely, causing the parent to lose sleep more easily, and even make noise, waking up the baby or partner.

As can be seen, there is a need for an improved crib or bassinette insert where breathable cuddling bumpers are placed in the right location and with the right space to cuddle the baby. The wide lateral window allows parents to see the baby through the mesh while lying in bed. All material is breathable, providing a safe environment for the baby.

BRIEF SUMMARY OF THE INVENTION

An improved crib or bassinette insert, according to this disclosure comprises breathable cuddling bumpers that are placed in the right location and with the right space to cuddle the baby. Also, the insert may comprise a wide lateral window that allows parents to see the baby through the mesh while lying in bed. All material is breathable, providing a safe environment for the baby.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention. Broadly, embodiments of the present invention provide an improved bassinette and crib insert that reduces the sleep supporting area that the baby will sleep on, making them feel safer.

The insert includes padded lateral cushions 3, named breathable cuddling bumpers, providing an additional cuddling feeling to the newborn. The insert surroundings and pad are made of a breathable material, making it a safe environment for the baby.

The insert has a wide "see-baby" window formed of a mesh that allows parents to see the baby without having to get up in bed, improving parents sleep. The insert has a tapered, inwardly converging side wall that narrows towards the flat sleeping surface. The sleeping surface, called anatomical pad, enables the baby to be placed on either side of the bassinette or crib insert, and has safe lateral support cushions to the baby. The insert is made of breathable material, making it a safe environment to the baby. The breathable cuddling bumpers are placed in the right location and with the right space to cuddle the baby. The wide lateral window allows parents to see the baby through the mesh while lying in bed. All material in breathable, providing a safe environment for the baby.

Figure 1:
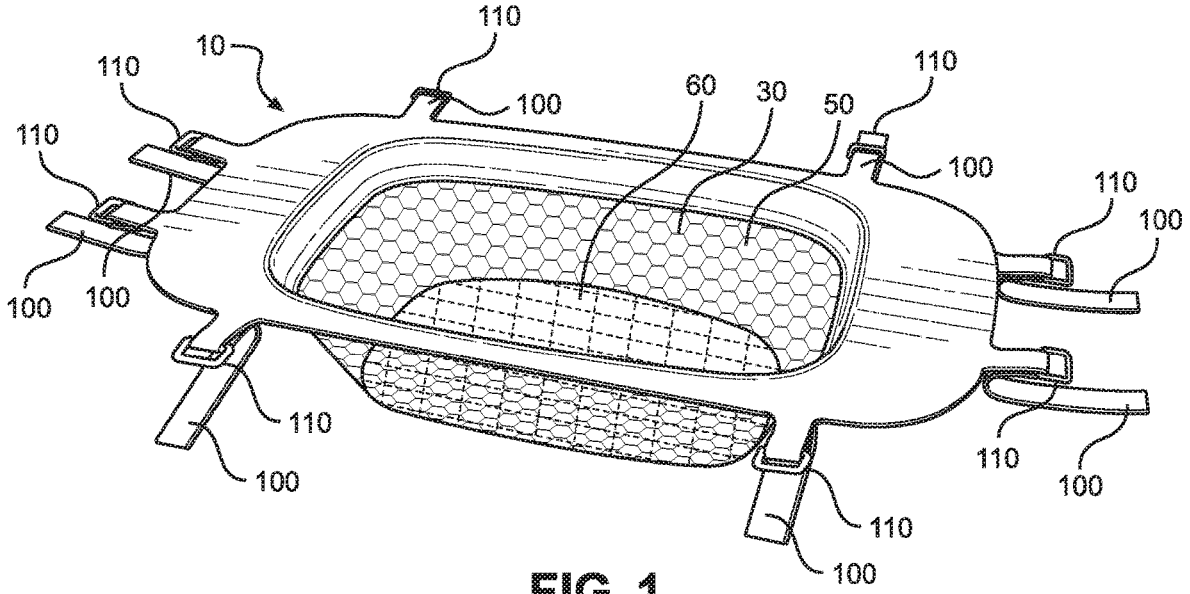
FIG. 1: is a perspective view of a first embodiment of a crib insert.
Figure 2:
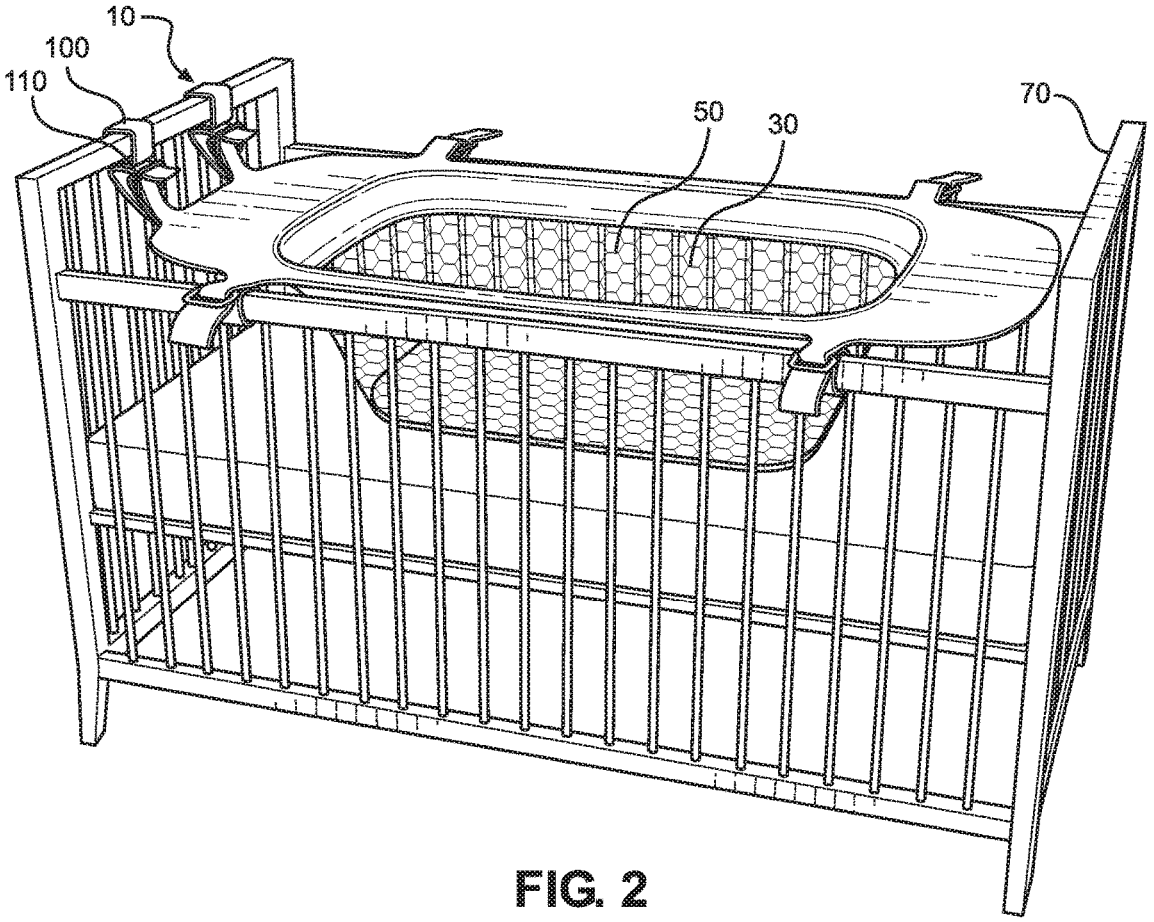
FIG. 2: is a perspective view of a first embodiment of a crib insert installed within a crib.
Figure 3:
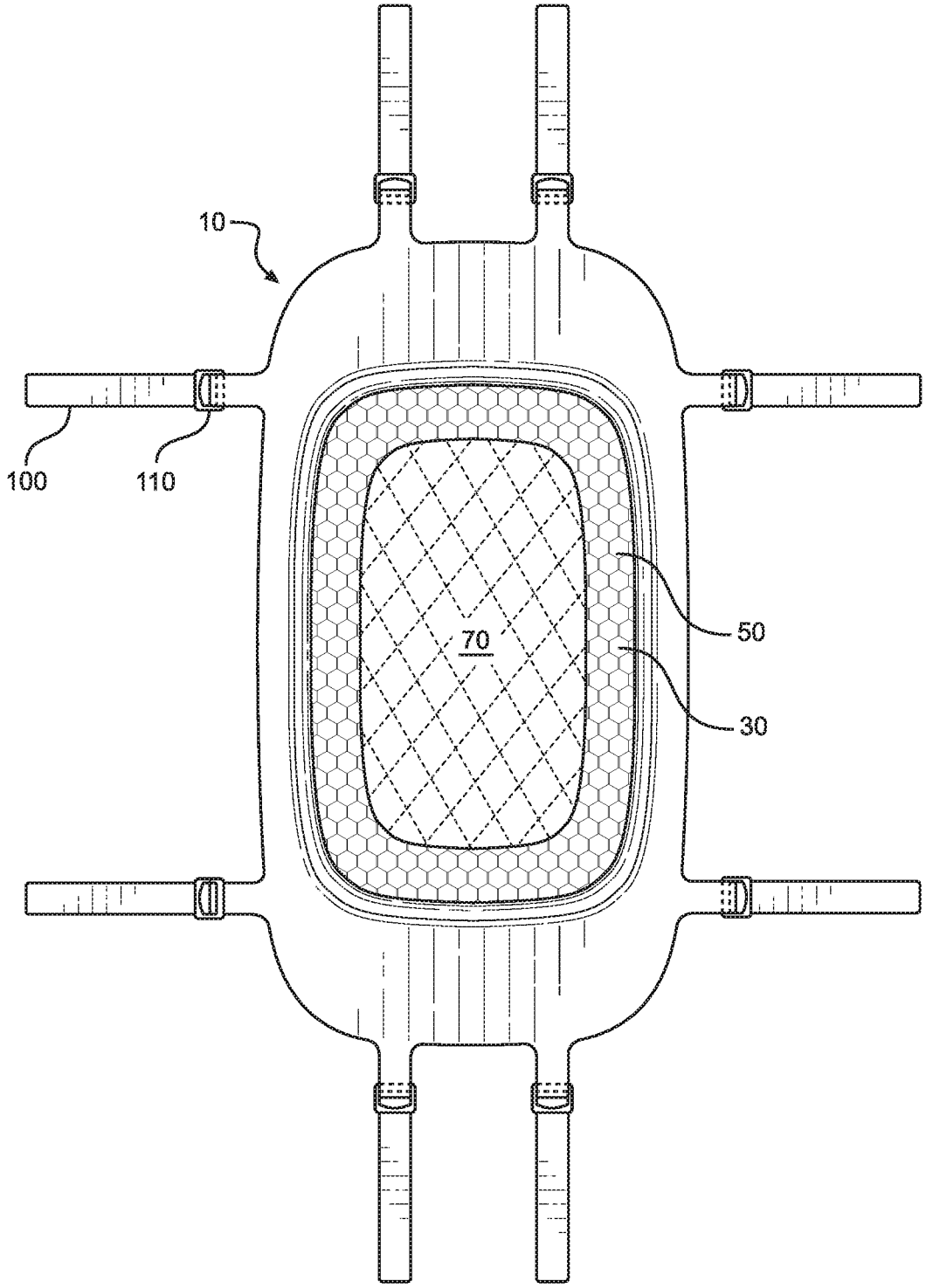
FIG. 3: is a top planar view a first embodiment of a crib insert.
Figure 4:
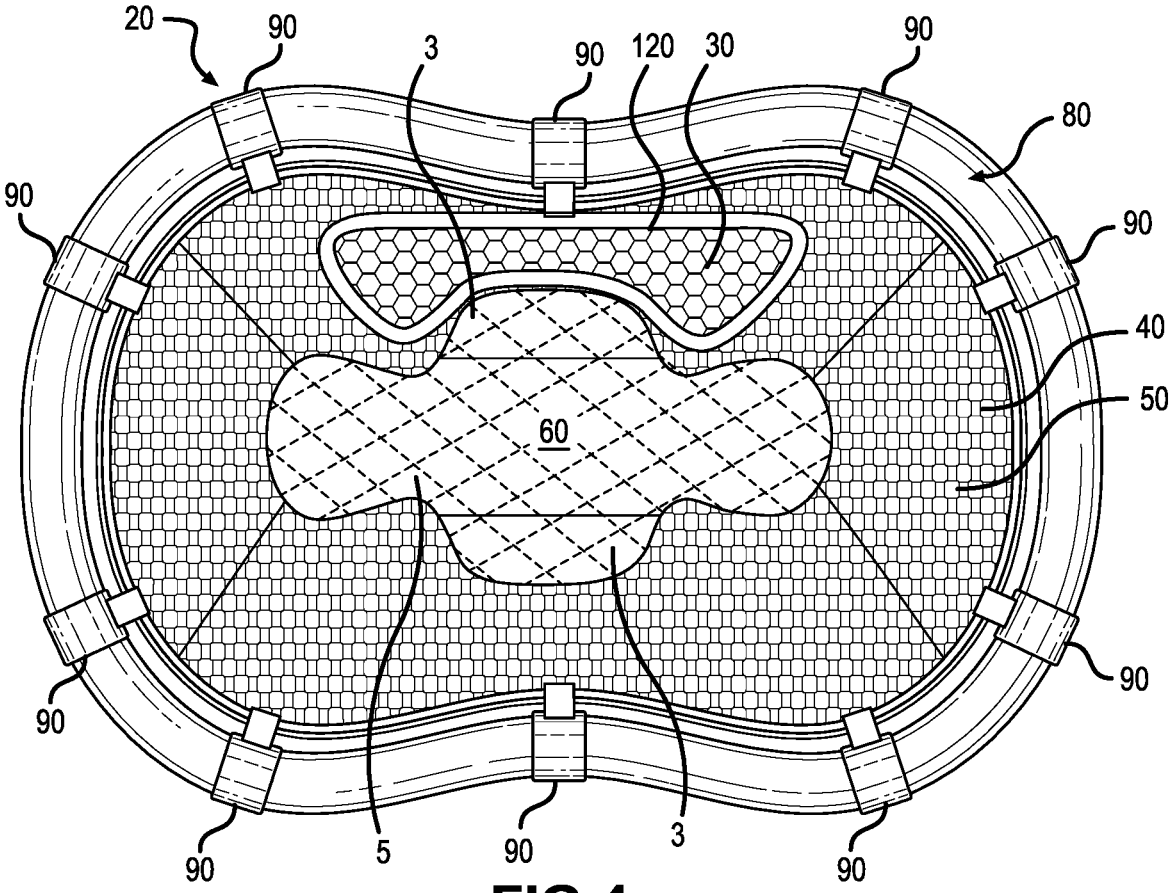
FIG. 4: is a top planar view a second embodiment of a bassinette insert.
Figure 5:
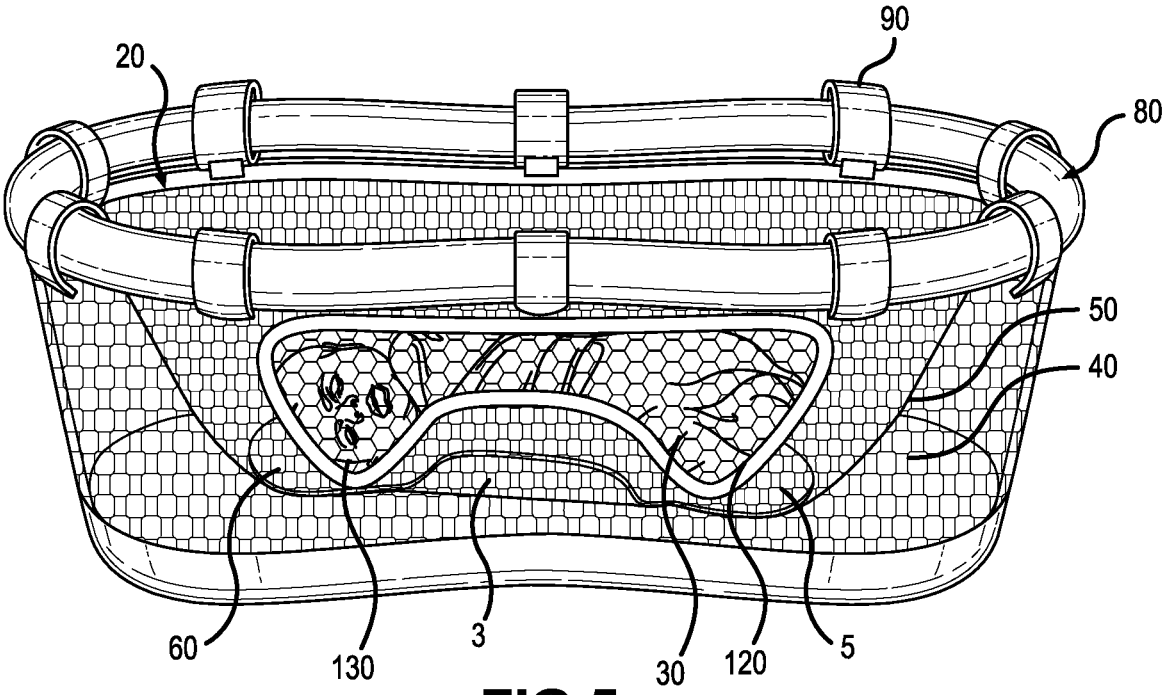
FIG. 5: is a side perspective view of a bassinette insert in use.

As seen in reference to the drawings, where like numbers are used to refer to like items throughout, there is shown in FIGS. 1-3 a first embodiment, according to this disclosure, of an insert 10 in a crib 70, and there is shown in FIGS. 4-5, a second embodiment, according to this disclosure, of an insert 20 in a bassinette 80. As shown in FIGS. 4-5, the insert 20 of the present invention may include: a wide see-through lateral window 120; a double-sided anatomic pad 60; a breathable cuddling bumper 3; a natural hypoallergenic tencel mesh in pad; a cotton pad surface 5; and breathable 3D mesh 50 in surroundings.

The 100% breathable 3D mesh 50 is installed inside the bassinette or crib, comprising the surrounding of the insert 10, 20. It is attached to the bassinette 80 or crib 70 with a plurality of plastic buckle hooks 90 or straps 100 and rings 110, respectively, at the top. The breathable mesh 50 is stitched to the double-sided anatomic pad 60. The anatomic pad 60 has a plurality of layers to provide a comfortable, breathable and hypoallergenic surface. The top layer 5, in contact with the baby 130, is preferably a 100% cotton fabric. Below the top layer 5 is a layer of natural hypoallergenic Tencel mesh, which enables air circulation to the pad. Along both sides of the center of the pad, there are the breathable cuddling bumpers 3. The wide see-baby lateral window 120 can be on one or both sides of the insert, stitched to the 3D mesh 50.

The insert is installed inside the bassinette 80 or with buckles that will be attached to the top bars of the bassinette 80 or crib 70. The pad 60 will lay on top of the bassinette or crib mattress, providing a narrower and flat surface for the baby to sleep. When placing the baby in the insert, both breathable cuddling bumpers 3 will touch the arms and sides of the baby, providing a feeling of being cuddled. The wide see-baby lateral window 120 will enable parents to see the baby through the mesh 30.

Once the plastic buckles 90, 3D air mesh 50, cotton, Tencel fabric, and polyester are procured, one can cut to the appropriate sizes and stitch them together to make the insert 10, 20. The buckles 90 will be at the top side of the mesh 50. The layers of the pad will be stitched at the bottom of the mesh 50. It is important to follow the correct measurements in order to achieve the cuddling feeling and still have a safe environment for the baby. The filling of the cuddling bumpers should be a layer of 3D mesh to maintain its breathability.

The wide see-baby window 120 can be bigger, smaller, on both sides or on each of the sides of the insert 10, 20. The attachment to the bassinette or crib can be done with plastic buckles 90 or any other device that will hold the insert in place. The pad can be of an organic material or with different fabrics. The shape of the pad can be different. The cuddling bumpers 3 could have different height and width. The 3D mesh 50 could be of other breathable material.

The following is a list of numerals utilized in FIGS. 1-5:

3 are lateral cushions named breathable cuddling bumpers;

5 is a top layer of the anatomical cushion or pad 60;

10 is a first embodiment of an insert in a crib;

20 is a second embodiment of an insert in a bassinette;

30 is a window mesh;

40 is the bassinette wall;

50 is three-dimensional mesh of the bassinette insert;

60 is the anatomical cushion or pad;

70 is a crib;

80 is a bassinette;

90 are hooks;

100 are straps;

110 are rings;

120 is a see-baby window; and

130 is a baby.

It should be understood, of course, that the foregoing relates to exemplary embodiments of the invention and that modifications may be made without departing from the spirit and scope of the invention as set forth herein.

What is claimed is:

1. A baby receiving apparatus for insertion into a bassinette including a sleeping surface with a top surface for a baby to rest thereon, the apparatus comprising:

a pad including a pad upper surface and a pad lower surface, the pad upper surface configured for the baby to rest thereon, and the pad lower surface configured to abut the top surface of the bassinette sleeping surface; and a sidewall surrounding the pad, the sidewall extending vertically between an upper portion and a lower portion, and the lower portion connected to the pad, wherein the pad further comprises a lower layer forming the lower pad surface, the lower layer including a breathable mesh.

2. A baby receiving apparatus for insertion into a bassinette including a sleeping surface with a top surface for a baby to rest thereon, the apparatus comprising:

a pad including a pad upper surface and a pad lower surface, the pad upper surface configured for the baby to rest thereon, and the pad lower surface configured to abut the top surface of the bassinette sleeping surface; and a sidewall surrounding the pad, the sidewall extending vertically between an upper portion and a lower portion, and the lower portion connected to the pad, the sidewall comprising a see-through fabric allowing the baby to be seen through the sidewall and a 3-dimensional mesh including a denser construction than the see-through fabric.

3. The apparatus according to claim 2, wherein the see-through fabric of the sidewall and pad are configured to be laterally spaced apart from the bassinette when the upper portion of the sidewall is attached to the bassinette above the pad upper surface and the top surface of the bassinette sleeping surface.

4. A baby receiving apparatus for insertion into a bassinette including a mattress for a baby to rest thereon, the apparatus comprising:

a pad including a flat section with a pad upper surface and a pad lower surface, the pad upper surface configured for the baby to rest thereon, and the pad lower surface configured to lay on the mattress;

a sidewall extending vertically and surrounding the pad, the sidewall defining a longitudinally extending window configured for the baby to be seen through the sidewall; and an attachment connected to the upper portion of the sidewall, the attachment configured to attach to the bassinette above a mattress upper surface and the pad upper surface.

5. The apparatus according to claim 4, further comprising:

a see-through mesh in the window.

6. The apparatus according to claim 4, wherein the sidewall comprises a see-through mesh and a breathable mesh including a denser weave than the see-through mesh, and the see-through mesh is in the window.

7. The apparatus according to claim 4, wherein the window is disposed entirely within the sidewall.

8. The apparatus according to claim 4, wherein the sidewall includes a plurality of fabrics comprising a see-through fabric and a breathable fabric including a denser weave than the see-through fabric.

* * * * *